United States Patent [19]

Valev

[11] Patent Number: 4,836,160

[45] Date of Patent: Jun. 6, 1989

[54] INTERNAL COMBUSTION ENGINE PROVIDED WITH A SOUND-INSULATING ENCLOSURE

[75] Inventor: Assen Valev, Perchtoldsdorf, Austria

[73] Assignee: Steyr-Daimler-Puch Aktiengesellschaft, Vienna, Austria

[21] Appl. No.: 241,859

[22] Filed: Sep. 8, 1988

[30] Foreign Application Priority Data

Sep. 9, 1987 [AT] Austria ..... 2276/87

[51] Int. Cl.[4] ..... F02B 77/11; G10K 11/00

[52] U.S. Cl. ..... 123/198 E; 181/204; 285/47; 60/323

[58] Field of Search ..... 123/198 E; 285/47; 60/323; 181/204

[56] References Cited

U.S. PATENT DOCUMENTS

| | | | |
|---|---|---|---|
| 4,011,849 | 3/1977 | Latham | 123/198 E |
| 4,164,262 | 8/1979 | Skatsche et al. | 181/204 X |
| 4,183,344 | 1/1980 | Kirchweger et al. | 123/198 E |
| 4,338,890 | 7/1982 | Shelby et al. | 181/204 X |
| 4,341,187 | 7/1982 | Absenger | 123/198 E |
| 4,484,751 | 11/1984 | Deuring | 123/198 E X |
| 4,509,475 | 4/1985 | Visek | 123/198 E X |

FOREIGN PATENT DOCUMENTS 0062030 10/1982 European Pat. Off. .

*Primary Examiner*—Tony M. Argenbright
*Assistant Examiner*—Eric R. Carlberg
*Attorney, Agent, or Firm*—Mamorek, Guttman & Rubenstein

[57] ABSTRACT

An internal combustion engine is provided with a sound-insulating enclosure (2), which defines a sealed passage extending through the enclosure. A passage which extends through the enclosure is sealed by a sealing ring (9), which consists of a rubber-elastic material and is disposed between an inner flanged ring (7), which is secured to the engine, and an outer flanged ring (8), which is secured to the enclosure (2). In order to provide sealing means which are satisfactory for a passage for the exhaust manifold (3), the inner flanged ring (7) carries a protective shield (10), which shields the inside surface of the sealing ring (9) and which defines with the sealing ring (9) a clearance (12), which contains a heat-resisting and sound-absorbing insulating material (11).

13 Claims, 2 Drawing Sheets

INTERNAL COMBUSTION ENGINE PROVIDED WITH A SOUND-INSULATING ENCLOSURE

BACKGROUND OF THE INVENTION

1. Field of the Invention

This invention relates to an internal combustion engine which is provided with a sound-insulating enclosure, which defines a sealed passage, particularly for the exhaust manifold, wherein the sealing means associated with the passage comprise a sealing ring, which consists of a rubber-elastic material and is disposed between an inner flanged ring that is secured to the engine block and an outer flanged ring that is secured to the enclosure.

2. Description of the Prior Art

An effective sound insulation of such engine cannot be ensured unless the enclosure encloses the engine as completely as possible and the enclosure has no unsealed passages. Besides, the enclosure must be connected to the engine block by supporting means which are highly elastic in order to provide an insulation against structure-borne sound. Those supporting means and the sealing means which are associated with passages extending through the enclosure must be able to take up and compensate the sometimes considerable relative movements which occur during operation. The known sealing means associated with such passages comprise an elastomeric sealing ring which is disposed between and vulcanization-bonded to two metallic flanged rings and may be designed in such a manner that they will sufficiently seal those passages which contain engine parts which will assume only moderate temperatures, such as the air intake duct, lines for coolant and fuel, and the like, because those parts will not adversely affect the temperature-susceptible sealing material. On the other hand, the sealing of passages for hot parts of the engine, particularly for the exhaust manifold, has previously given rise to great difficulties because the seal has been subjected to very high temperatures and in that case even expensive structures provided with special cooling means have not produced the desired result. Heat-resisting metal bellows seals have not been satisfactory too because they do not sufficiently insulate against structure-born sound.

The sealing of a passage will be particularly difficult if the passage is covered by a cap which is required for sound insulation and which adjoins the enclosure and covers the exhaust manifold. In that case, a sound insulation is required between the enclosure and the cap and an oil-resisting seal is required to prevent an ingress of oil or the like into the hot cap. EP No. 0 062 031 B1 discloses for the mounting of such cap a loose assembly comprising an elastic seal and heat-resisting laminated flat seals, which insulate against structure-borne sound. But in spite of the high expenditure involved in the manufacturing and installation of such cap mounting the latter is not fully satisfactory.

SUMMARY OF THE INVENTION

It is an object of the invention to eliminate the disadvantages outlined hereinbefore and to provide an engine with a sound-insulating enclosure which is of the kind described first hereinbefore and is provided at a passage with sealing means which are relatively simple but are resistant, oil-tight and sound-insulating and particularly suitable for the mounting of a dry exhaust manifold cap on a wet enclosure for an engine block.

That object is accomplished in accordance with the invention in that the inner flanged ring carries a protective shield, which shields the inside surface of the sealing ring and defines a clearance with the sealing ring, and said clearance contains a heat-resisting and sound-absorbing insulating material. That protective shield which is adjoined by insulating material will ensure the required protection of the sealing ring against the heat of the hot engine part extending through the passage and the insulating material, which may consist, e.g., of mineral wool, such as Triton-Kaowool, will also provide for a sound insulation. For this reason the sealing ring made of a suitable elastomer will constitute an oiltight and elastic supporting means for connecting the enclosure to the engine block and will not be adversely affected by heat.

If the opening of the passage is covered by a cap, which adjoins the enclosure, it is contemplated within the scope of the invention to provide the protective shield with an end face which faces a mounting flange of the cap and defines with said mounting flange a gap, which contains a layer of insulating material. In such an arrangement the enclosure and the cap will be entirely sound-insulated from each other as is required for an effective insulation against the engine noise. The layer of insulating material may consist of the same material as the insulating material at the protective shield and will ensure that the heat protection provided by the protective shield is supplemented toward the outer flanged ring and that even the joint between the cap and the enclosure will be insulated. If the end face of the protective shield is constituted by an outwardly protruding rim of the protective shield, that rim will also provide a liquid-restraining seal, which will prevent an ingress of oil or the like into the adjoining cap.

In such an arrangement it will be particularly desirable to provide drain passages between the protective shield and the adjoining insulating material and/or the layer of insulating material and/or between the outer flanged ring and the adjoining insulating material. Such drain passages may simply be defined by corrugations of the protective shield and/or of the flanged ring and will facilitate the removal of any oil and will ensure that the insulating material will not excessively be soiled. For instance, if a damaged exhaust seal permits unburnt oil to enter the region of the passage, such oil will not be able to damage the seal because it will be conducted outwardly along the protective shield. Similar remarks are applicable to a condition in which the sealing ring is defect because in that casing the oil which emerges from the interior of the enclosure can flow outwardly along the outer flanged ring or along the shield. If the emergence of such oil becomes visible outside the seal, this will be an early indication of a defect seal and of the need for repairs.

In a particularly desirable embodiment of the invention a passage for the exhaust manifold is provided with an inner flanged ring which is spaced around the exhaust manifold and is secured to the cylinder head of the engine in metallic contact therewith, a peripheral seal is provided there and a heat-protective strip is preferably provided between the inner flanged ring and the exhaust manifold. In that case an additional heat protection is provided for the seal proper which is associated with the passage for the exhaust manifold because the inner flanged ring is in metallic contact with the cylinder head and will be cooled by the means for cooling the cylinder head and the heat flux between the exhaust manifold and the inner flanged ring will be interrupted by the air gap which is left or preferably by the interposed heat-protective strip, which may consist, e.g., of asbestos. In that arrangement the peripheral seal made of an elastomeric material will seal the joint between the inner flanged ring and the cylinder head.

DETAILED DESCRIPTION OF THE PREFERRED EMBODIMENT

Figure 1:
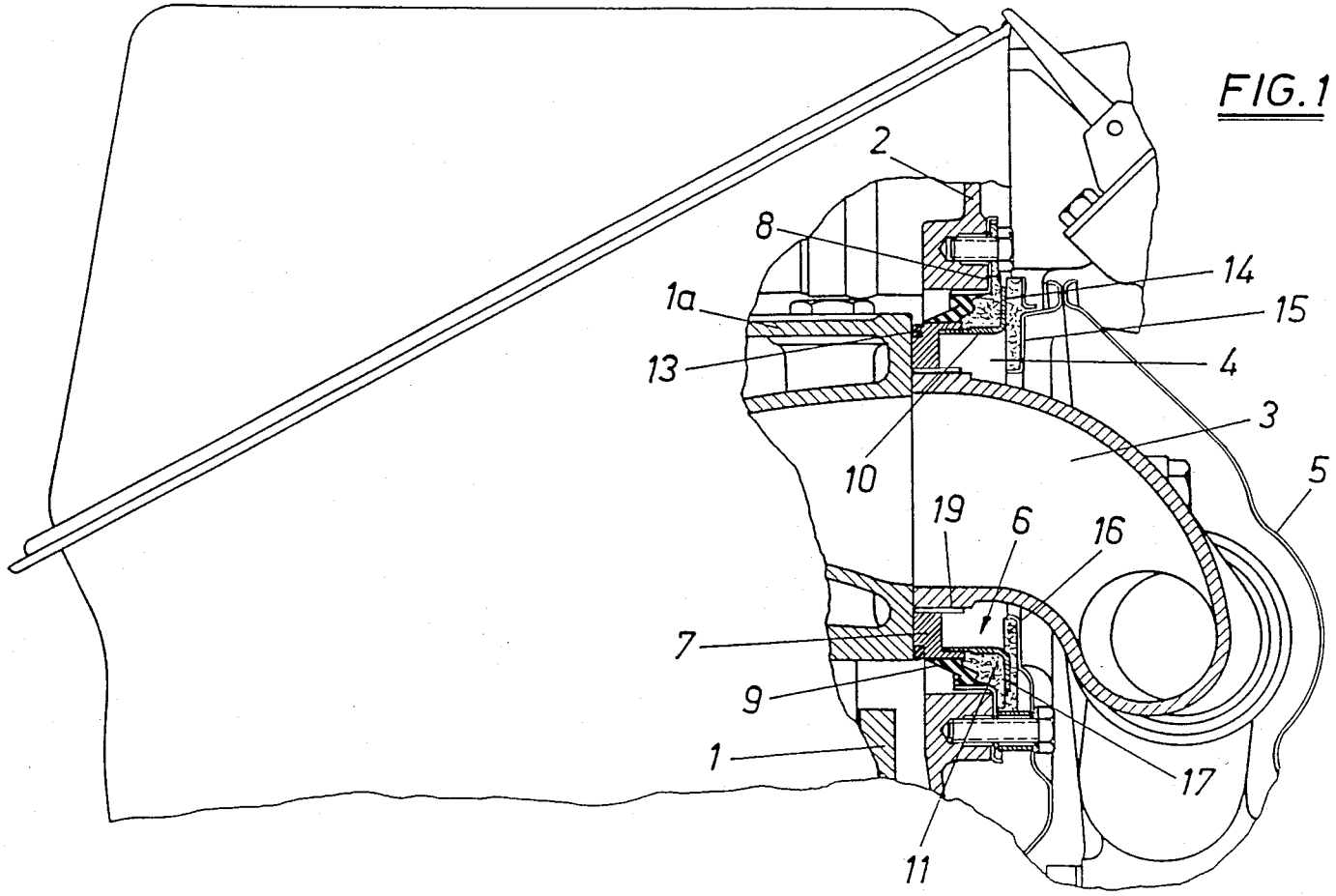
FIG. 1 is a fragmentary vertical sectional view showing a part of an internal combustion engine which is provided with a sound-insulating enclosure designed in accordance with the invention.
Figure 2:
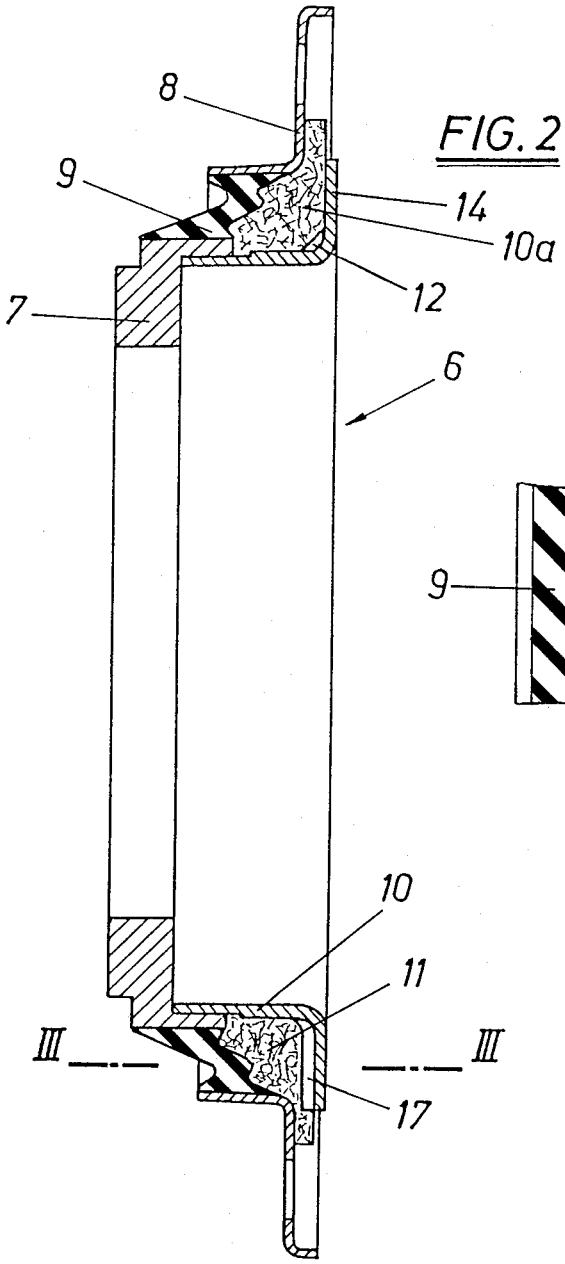
FIG. 2 is an enlarged transverse sectional view showing the sealing means associated with a passage extending through said enclosure.
Figure 3:
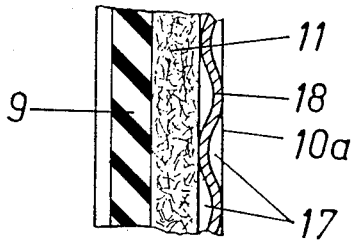
FIG. 3 is a sectional view taken on line III—III in FIG. 2.

Details of the invention will now be explained with reference to an illustrative embodiment shown in the drawing.

The engine block 1 of an internal combustion engine is enclosed by a sound-insulating enclosure 2, which is formed with a passage 4, through which an exhaust manifold 3 extends. The passage 4 is covered by a cap 5, which adjoins the enclosure 2 on the outside thereof and provides a sound insulation for the exhaust manifold 3, which transmits structure-borne sound.

The passage 4 is sealed by sealing means 6, which comprise an inner flanged ring 7, which is secured to the cylinder head 1*a*, an outer flanged ring 8, which is tightly secured to the enclosure 2 by means of a preferably liquid sealant, a sealing ring 9, which is disposed between and vulcanized to the inner and outer flanged rings, a protective shield 10, which has been joined by pressure to the inner flanged ring 7 and shields the sealing ring 9 from the exhaust manifold 3, and heat-resisting and sound-absorbing insulating material 11, which fills the space 12 that is defined by the protective shield 10, the sealing ring 9 and the flanged ring 8. The inner flanged ring 7 is mounted on the cylinder head 1*a* in metallic contact therewith so that the flanged ring 7 will be cooled by the means for cooling the cylinder head. An elastomeric peripheral seal 13 is provided, which is preferably circular in cross-section and ensures a sealing of the joint between the cylinder head 1*a* and the flanged ring 7. The protective shield 10 comprises an outwardly protruding rim 10*a*, which has an end face 14 for adjoining the cap 5. The cap 5 is provided with a mounting flange 15, which adjoins the end face 14 with a layer of insulating material 16 interposed for sound insulation.

The protective shield 10 and the insulating material 11 ensure that the sealing ring 9 will not be excessively heated so that it will satisfactorily perform its sealing and supporting functions also adjacent to a passage for the exhaust manifold. The insulating material 11 and the insulating material layer 16 also ensure an excellent sound insulation at the joint between the enclosure 2 and the cap 5 so that an insulation against the engine noise will also be ensured adjacent to the exhaust manifold.

Besides, the protective shield 10 will ensure that any oil which has seeped through a leak in the exhaust seal or through or past a defect sealing ring 9 and has entered the region of the passage will not enter the cap 5 because such oil will be drained over the protective shield into the lower region between the cap 5 and the enclosure 2. For that purpose, drain passages 17 are preferably provided between the protective shield 10 and the insulating material 11 or the insulating material layer 16. Such passages may simply be formed by corrugations 18 of the protective shield. Similar passages may be provided between the outer flanged ring 8 and the insulating material 11.

The protection of the sealing means 6 can be improved in that an annular gap is left between the inner flanged ring 7 and the exhaust manifold 3 and a heat-protective strip 19 consisting, e.g., of asbestos, is disposed in said annular gap so that the transfer of heat between the exhaust manifold 3 and the flanged ring 7 will be restricted.

I claim:

1. In an internal combustion engine comprising an engine block, a sound-insulating enclosure, which surrounds said engine block and defines a passage extending through said enclosure, an engine part extending from said engine block in said passage through said enclosure, and sealing means associated with said passage and comprising an inner flanged ring secured to said engine block, an outer flanged ring secured to said enclosure adjacent to said passage, and a sealing ring made of a rubber-elastic material and held between said inner and outer flanged rings and having an inside surface which surrounds and faces said engine part, the improvement residing in that said inner flanged ring carries a protective shield, which extends between said engine part and said inside surface and defines a clearance with and entirely covers said inside surface, and said clearance contains a heat-resisting and sound-absorbing insulating material.

2. The improvement set forth in claim 1 as applied to an engine wherein said engine part consists of an exhaust manifold.

3. The improvement set forth in claim 2 as applied to an engine comprising a cylinder head, wherein said inner flanged ring is spaced around said exhaust manifold and is secured to said cylinder head in metallic contact therewith and a peripheral seal is provided in contact with said cylinder head and with said inner flanged ring.

4. The improvement set forth in claim 3, wherein a heat-protective strip is interposed between said inner flanged ring and said exhaust manifold.

5. The improvement set forth in claim 1 as applied to an engine which comprises a cap, which adjoins said enclosure and covers said passage on the outside of said enclosure, wherein said protective shield has an outer end face which faces away from said engine block, said cap comprises a mounting flange facing said end face and defining a gap therewith, and said gap contains a layer of insulating material.

6. The improvement set forth in claim 5, wherein said protective shield has a radially outwardly protruding rim, which is formed with said end face.

7. The improvement set forth in claim 5, wherein said drain passages are provided between said protective shield and said layer of insulating material.

8. The improvement set forth in claim 5, wherein said protective shield is formed with corrugations defining drain passages between said protective shield and said layer of insulating material.

9. The improvement set forth in claim 1, wherein drain passages are provided between said protective shield and said insulating material.

10. The improvement set forth in claim 1, wherein drain passages are provided between said outer flanged ring and said insulating material.

11. The improvement set forth in claim 1, wherein said protective shield is formed with corrugations defining drain passages between said protective shield and said insulating material.

12. The improvement set forth in claim 1, wherein said outer flange ring is formed with corrugations defining drain passages between said outer flange and said insulating material.

13. In a sound-insulating enclosure which is adapted to surround an engine block of an internal combustion engine and defines a passage, which extends through said enclosure and is adapted to contain an engine part extending from said engine block through said enclosure, which enclosure comprises sealing means associated with said passage and comprising an inner flanged ring, which is adapted to be secured to said engine block, an outer flanged ring secured to said enclosure adjacent to said passage, and a sealing ring made of a rubber-elastic material and held between said inner and outer flanged rings and having an inside surface which is adapted to surround and face said engine part, the improvement residing in that said inner flanged ring carries a protective shield, which extends radially inwardly of said inside surface and which defines a clearance with and entirely covers said inside surface, and said clearance contains a heat-resisting and sound-absorbing insulating material.

* * * * *